United States Patent [19]

Gerth

[11] 4,068,328

[45] Jan. 17, 1978

[54] CONVERTIBLE FURNITURE

[76] Inventor: William V. Gerth, 451 Phillip St., Waterloo, Ontario, Canada

[21] Appl. No.: 726,564

[22] Filed: Sept. 27, 1976

[51] Int. Cl.[2] ..... A47C 17/04; A47C 17/14

[52] U.S. Cl. ..... 5/13; 5/28; 5/51 D

[58] Field of Search ..... 5/13, 28, 51 D

[56] References Cited

U.S. PATENT DOCUMENTS

| | | | |
|---|---|---|---|
| 1,081,590 | 12/1913 | Dyke | 5/51 D |
| 1,945,186 | 1/1934 | Frank | 5/51 D |
| 2,584,145 | 2/1952 | Martin | 5/13 |
| 2,985,893 | 5/1961 | Trossman | 5/13 |
| 3,284,812 | 11/1966 | Koch | 5/13 |
| 3,345,651 | 10/1967 | Fox | 5/28 |
| 3,431,567 | 3/1969 | Spitz et al. | 5/13 |
| 3,654,642 | 4/1972 | Barabas | 5/13 |
| 3,771,178 | 11/1973 | Inman | 5/13 |
| 3,934,281 | 1/1976 | Brindisi | 5/13 |

*Primary Examiner*—Paul R. Gilliam
*Assistant Examiner*—Alex Grosz
*Attorney, Agent, or Firm*—K. Maxwell Hill

[57] ABSTRACT

The following specification discloses a chesterfield that is convertible into a double bed without a requirement for changing any part of the chesterfield frame and which has the normal seat depth for sitting comfort. The bed is stored beneath the seat cushions and is foldable inwardly lengthwise of the chesterfield with part of the folded bed storable beneath the back rail or deck of the seat. The bed is folded lengthwise and consists of a pair of clam-shell appearing tube members pivotably attached to a pair of channel members with link fabric for holding a mattress stretched between the tubes and a mid-cross tube. The channels and tubes form a 'U' shape when folded down into the bottom of the chesterfield with the opening of the 'U' facing the back of the chesterfield. The bed frame is held to the lower side frames of the chesterfield by a bearing bracket through a chain of links connected together in pivotable foldable relation. A 'U' shaped torsion tube is pivotably connected to each side bracket across the bottom of the chesterfield with the arms of the 'U' connected to the chain of links to become the legs of the bed proximate the chesterfield when the bed is folded out. Another pair of legs is connected to the chain of links to fold out with the unfolding of the upper half of the clam-shell to form the front legs of the bed. The linkages from the front legs through the torsion tube to the bracket form an upwardly thrusting bridge to maintain the bed in load bearing rigidity in the out-folded position without the necessity for a mid-section support or leg.

2 Claims, 6 Drawing Figures

CONVERTIBLE FURNITURE

FIELD OF THE INVENTION

The present invention relates to a chesterfield having a pull-out bed and mattress beneath its seat cushions. The mechanism for converting the chesterfield or sofa into a proper bed can be stored beneath the cushions of the chesterfield to allow it to function as a proper chesterfield without moveable arms or back. In particular, the invention herein provides a normal low profile sofa frame with the modern low front height and the proper seat depth suited for normal North American adults sitting in comfort while concealing a full adult size bed frame within it. The bed can be pulled out to form a centre-folding mattress and spring bed after the removal only of the sofa-chesterfield cushions.

The following disclosure contains a full description of the invention and of the best mode known to the inventor of taking advantage of and constructing the same.

Prior Art

It is known to make sofa type furniture convertible into beds by utilizing the sofa seat spring member for the bed and to provide the spring with frame, legs and linkage members that can allow the seat to be pulled out and used for the bed spring.

It is also known that a normal North American adult requires less depth of seat to rest in comfort that he requires width of bed to lie in comfort. To be functional both as a perfect bed and as a perfect sofa the prior art has devised sofa back-rests which are moveable to allow for a full width of bed along the length of the sofa with a second length being trundled out from beneath it or alternatively to store a bed foldable across its middle —i.e. from side to side, and partially stored beneath the back rest which is fixed. The disadvantage of the latter type of bed is that when it is in extended double-bed position a permanent fold or crease develops across the bed that will be sensed easily by both persons using the structure as a bed, disturbing their comfort and resulting in an unsatisfactory product.

The object of the present invention is to return to the former system of storing a double bed spring and mattress beneath and within a chesterfield sofa structure of furniture by folding the spring and mattress lengthwise to ensure that the fold will locate between the sleeping partners of the bed thereby disturbing neither.

It is further an object of the present invention to provide linkages to the folded-out structure when used as a bed which impart an upward stress to the 'top' and 'bottom' ends of the bed thereby preventing sag to the middle of the frame when centre legs are not employed.

It is a still further object of the present invention to provide a structure to a pull-out bed spring that can be downwardly stored into the bottom of a sofa frame thereby allowing the mattress held between the folded spring to be the seat of the sofa after only cushions are disposed above the folded structure since a low deck had been achieved by the spring.

To ensure that a proper edge is provided the sofa to allow the cushions to rest squarely on the deck provided by the folded spring, tension cushion supports are spaced apart between a pair of centre bottom members traversing the frame structure lengthwise of its mid-section.

A known disadvantage of convertible bed-sofa furniture that has one side of a double bed fold out from the other side which remains part of the length of the sofa, is that leg means must be provided at the mid or joint section, thereby creating a structure difficult to balance and creating a storage problem for the legs when in the fold-away posture within the sofa frame. It is the principal object of the present invention to provide a main centre action member to give upward thrust to the structure when in the fold-out position and to unite the folding mechanism to it to allow smooth action to the folding operation when being moved into or out of bed position from within the sofa frame. The main centre action member locates itself forward adjacent to the front edge of the sofa frame when the structure is in the open posture thereby, when combined with the linkage hereinafter disclosed, eliminating the necessity of providing mid-section support legs.

It is also an object of the invention to provide a convertible bed-sofa wherein the sofa frame can be fully and permanently upholstered and only its cushions being removed to convert it to a bed thereby giving the structure of a normal sofa when in use as such.

With the considerations and inventive objects herein set forth in view, and such others as may become apparent from consideration of this disclosure and specification, the present invention consists of and is hereby claimed to reside in the inventive concept which is comprised, embodied, embraced or included in any method, process, construction, composition, arrangement or combination or parts, or new use of any of the foregoing which may herein be exemplified in one or more specific embodiments of such concept, reference being had to the accompanying drawings in which:

IN THE PREFERRED EMBODIMENT AS DEPICTED IN THE DRAWINGS

Figure 1:
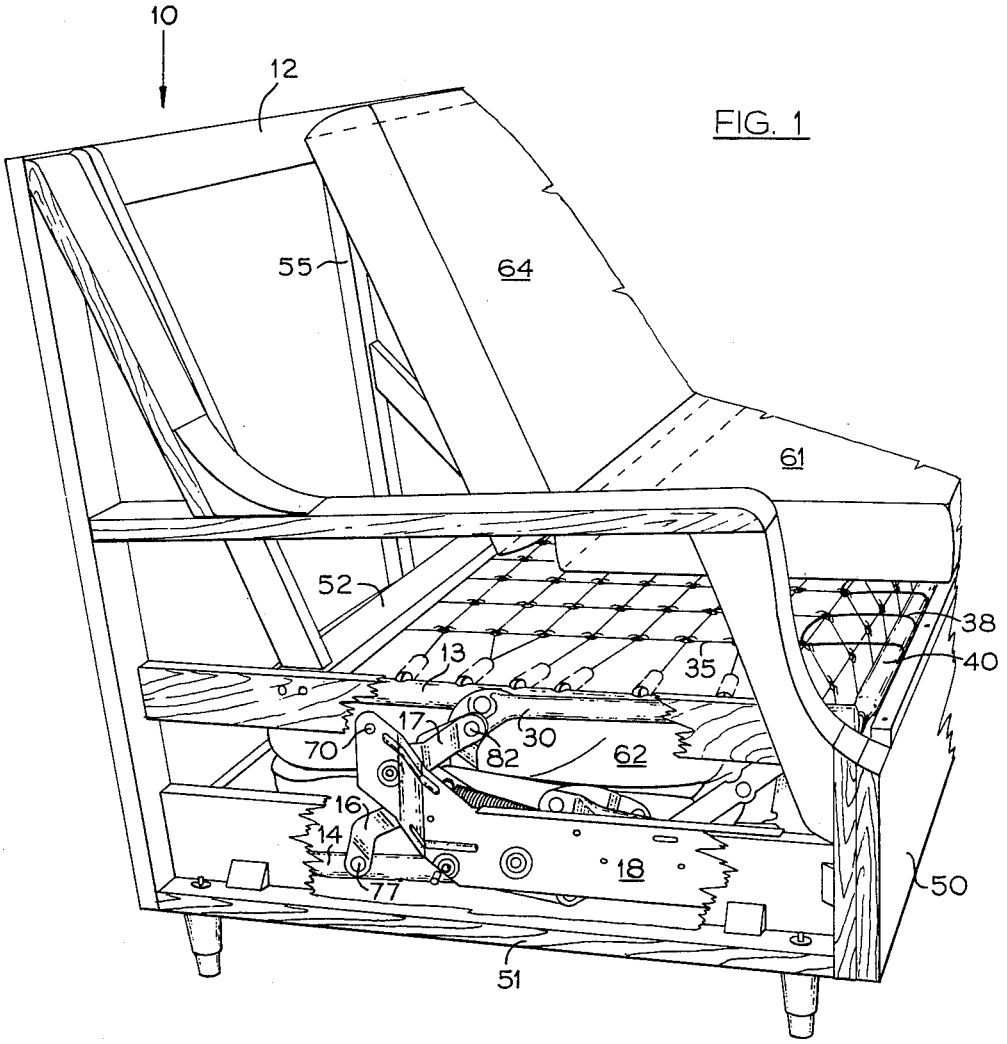
FIG. 1 is a perspective view of a chesterfield frame viewed from one end and partially cut away at the mid-section to show the bed spring and pull-out mechanism stored within the frame.

A chesterfield having a pull-out spring and mattress convertible into a bed is enumerated 10 in FIG. 1 of the drawings and is shown unupholsetered to indicate how the folded spring and mattress stores below the back rail or deck 52 of the chesterfield frame.

The chesterfield is shown having a back member 12, a bottom front frame 50 and side member 51 and back frame 55.

A base plate 18 is connected to one side of the bed mechanism and fixed to the side of the chesterfield frame. A second base plate is fixed to the other side of the chesterfield frame and attached to the bed mechanism. The base plate 18 bears the weight of the bed movement through pivot points 70, 71 and 72 (FIG. 2) and also through the point of attachment of the main spring 24 which is attached between the frame and the spring plate 26 carried by the main torsion tube 22.

It will be understood in the following discussion that both ends of the bed mechanism are similar in structure and attached to the chesterfield frame by a base plate. The drawings only show, however, the structure for one end. The discussion will be directed to the interaction of the linkages for one end of the mechanism.

The bed itself is formed of a pair of tube members 14 and 13 and upper and lower center tubes 40, 20.

The usual link mesh 35 for holding a mattress 62 is attached in the usual manner as shown, to the surrounding tubes 13, 14.

In FIG. 1 it will be seen how a chesterfield back cushion 64 rests against the frame and the back deck rail 52 while being supported by the link mesh of the spring 35 of the stored bed. The seat cushion 61 is also supported by the linkage 35 and the upper edge of the front 50 of the chesterfield frame. It is known in the lengthwise folding of a convertible bed that the spring mesh must be allowed to curve at the areas where the combination spring and mattress is folded resulting in a gap between it and the front of the chesterfield at the position where the upper chesterfield cushions are to be supported. The result is that an uncomfortable sag is imparted to the cushions by a seated person at the forward part of the seat giving a most unsatisfactory product.

It is an object of the present invention to provide a support for the sofa cushions that is uniform across its width, without sagging portions anywhere. The above object is achieved by spacing a plurality of spring members 38 to the mattress spring linkage 35 and stretching it over an edge tube 40 and downwardly sprung into attachment to a lengthwise running lower centre tube 20 fixed to the side channels 60. When the bed is in the stored position of FIG. 1, the spring edges 38 and 40 maintain the proper uniform support for the cushions to prevent sag. When the bed is opened as in FIG. 5 to provide mattress and bed support, the spring edge members 38 lie downwardly from the spring with no interference to the bed.

Figure 5:
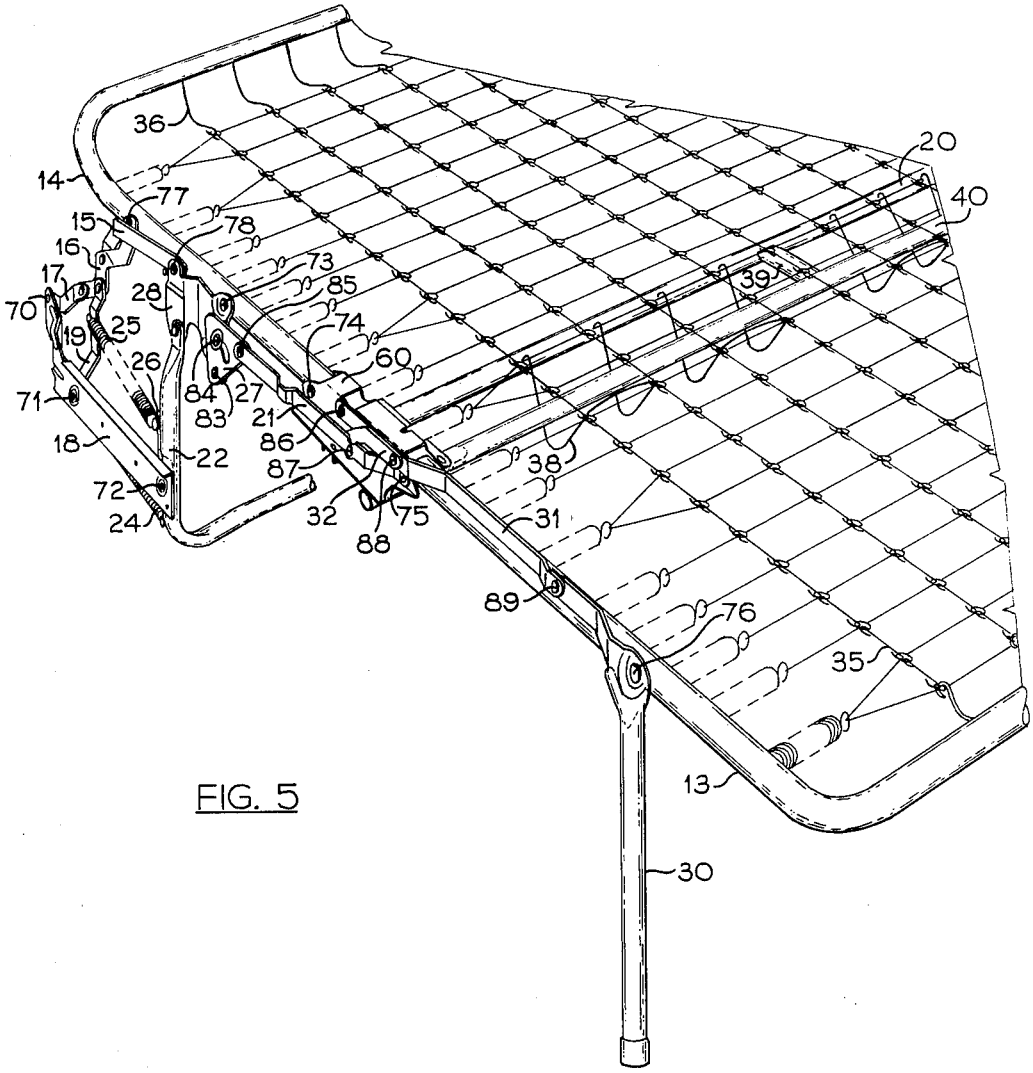
FIG. 5 is a perspective view of the bed spring and frame partially cut-away and showing the converting mechanism on one side as connected to the frame when the outward side has been completely folded out to be held by the leg support shown.

The linkage mechanism operates in two main stages from its storage position of FIG. 1 to its completed bed position of FIG. 5. The lock plate member 27 operates for both stages.

Figure 2:
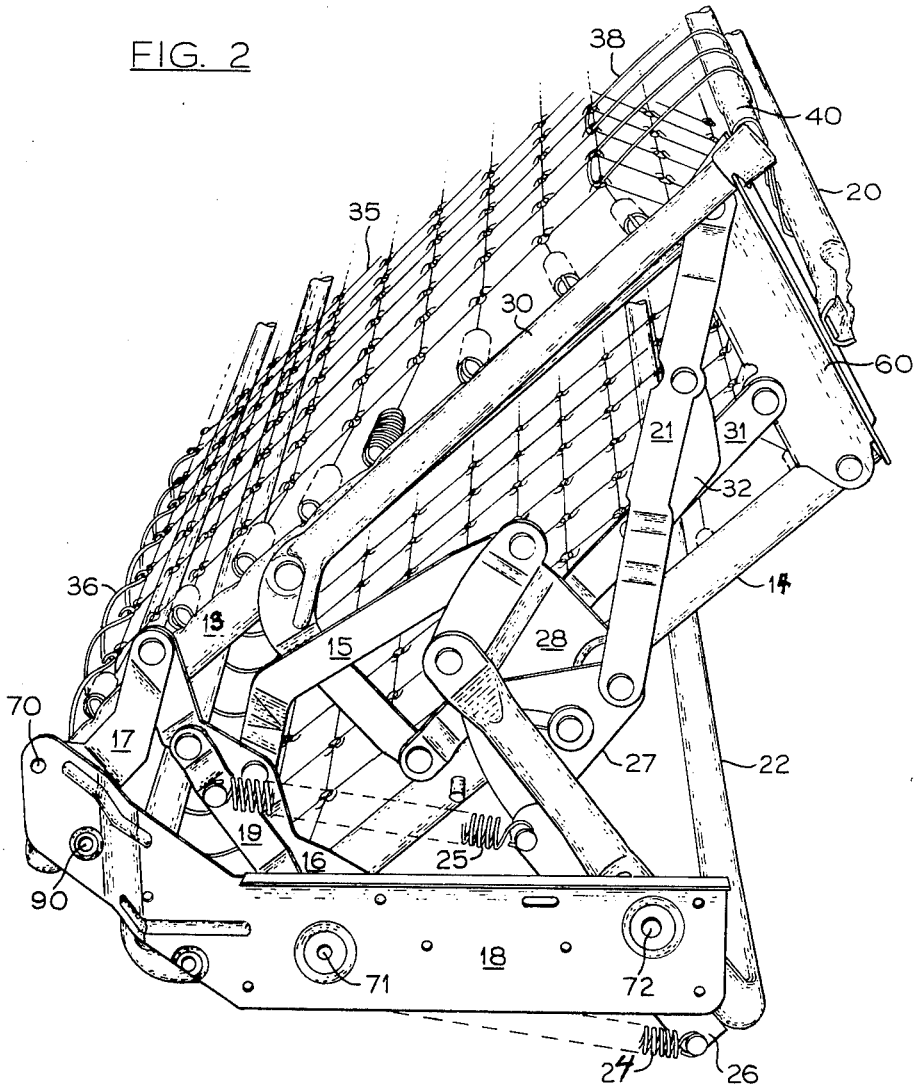
FIG. 2 shows a folded bed spring and frame with the associated linkages of the invention in the pulled-out position where the combination has cleared the back rest and bottom rail deck of the chesterfield frame prior to the one side of the bed spring being pulled out.

In FIG. 2 the bed mechanism is shown being pulled forward in the frame to allow the tubes 14 and 13 with a mattress sandwiched between them to clear the back rail 52. The first movement of the mechanism is to impart a downward and forward pull to the closed and meeting edges of tubes 14 and 13. A person performs the movement of the first stage by pulling upwards on tube 40 until the main load bearing tube 22 locks in the upright position shown in FIG. 3 by the locking of members 15, 16, 17, and 19 in the extended position of FIG. 3, and with the swing lever plate 28 having one side where pivoted at 78 to main link 15 directly above the pivot point 79 between swing lever 28 and the bearing tube 22. The scissor action of the folded linkages of FIG. 2 open out into the box frame shown in FIGS. 3 and 4 to provide a rigid load bearing structure capable of transferring the weight of the body lying on the bed, directly through main bearing member 22, to plate 18.

Rear swing lever 16 is pivotable about Rear link 17 at pivot 82, pivotable with main link 15 at pivot 80, pivotable with link 19 and pivot 81, and pivotable on the tube 14 at pivot 77. Link 17 is pivotable on base plate 18 at pivot 70 and link 19 is pivotable on the base plate at 71. Link 16 is "W" shaped to carry the other links with it in unison when the mechanism is being carried forward and upward and provides the means for pulling attached links in foldable position in the one motion and into the box-like frame and load bearing posture in the outward stage. When the main tube is vertical with main link 15 thrusting upward and forward on the swing lever plate 28 at pivot point 78, the bed half formed within clam-shell shaped tube 14 is rigid and fixed against any further outward movement and capable of holding against downward pressure. Only a lift upward, as when refolding to store beneath the back rail, will break the interlock of link 16 with main link 15. Link 19 being slightly backwardly locking during the setting of the first stage assists in the interlock of the main link and further provides the means of carrying the bearing load from the bed from pivot point 17 through link 16 to the base plate 18 without creating any forward thrust. Springs 24 and 25 are attached to a spring plate 26 which is fixed to the bearing tube 22 to maintain a backward force on the bottom of the tube 22 to prevent any movement on the bed during usage from lifting the outer side of the bed and flipping it closed, such as when one person rolls inward toward the sofa frame. The primary purpose of the springs is to assist the person pulling the bed from beneath the frame, to lift the mass of mattress and mechanism. The weight of the mattress will hold the bed folded under the sofa but a small woman or child can easily lift the mechanism to the first locking stage because the springs are in their stretched tensed position when in the folded down posture and react with the upward pull of a user on tube 40, to spring back to an untensed state, by pulling backward on the bottom of tube 22.

A Stop 90 is provided in base plate 18 to prevent the rear link 17 from carrying the attached mechanism downward and backward further than a set point thereby preventing the folded bed from striking the end of the sofa frame or the floor.

Figure 3:
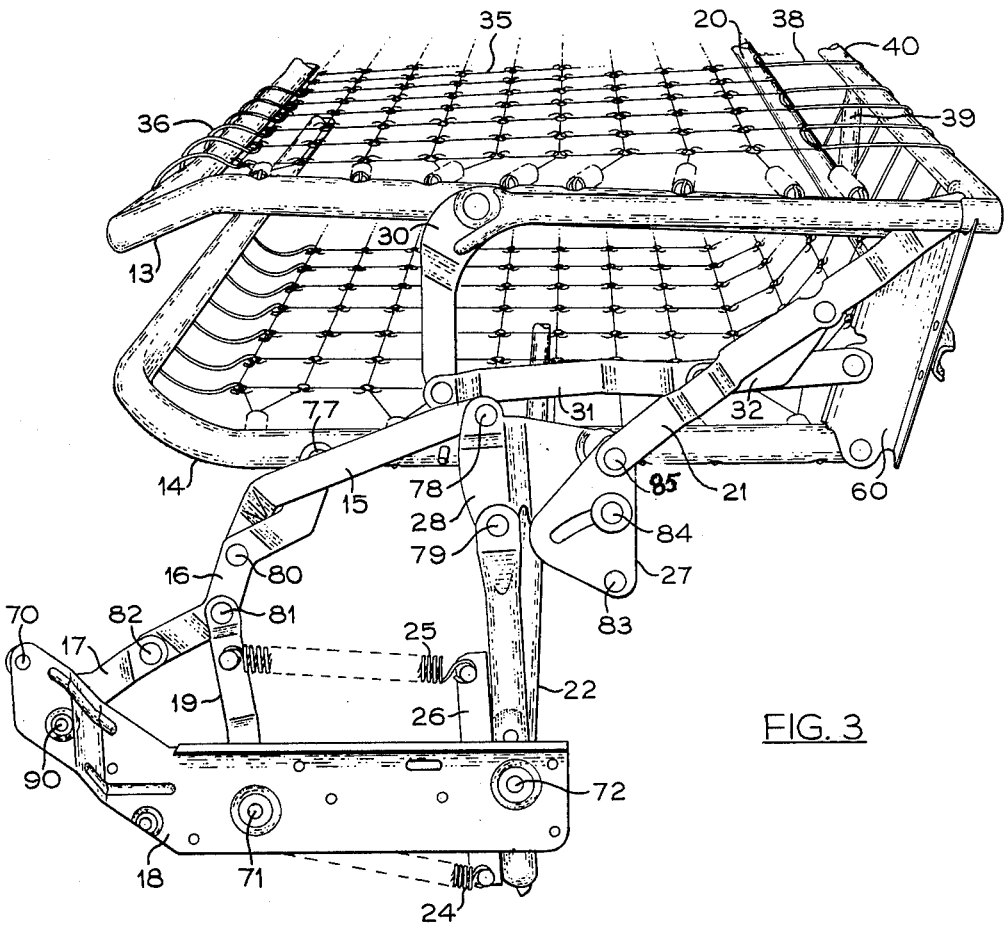
FIG. 3 shows the completion of the first stage of conversion of the mechanism to a bed—namely the extension upward of the mechanism and the locking of the back legs into bearing position.
Figure 4:
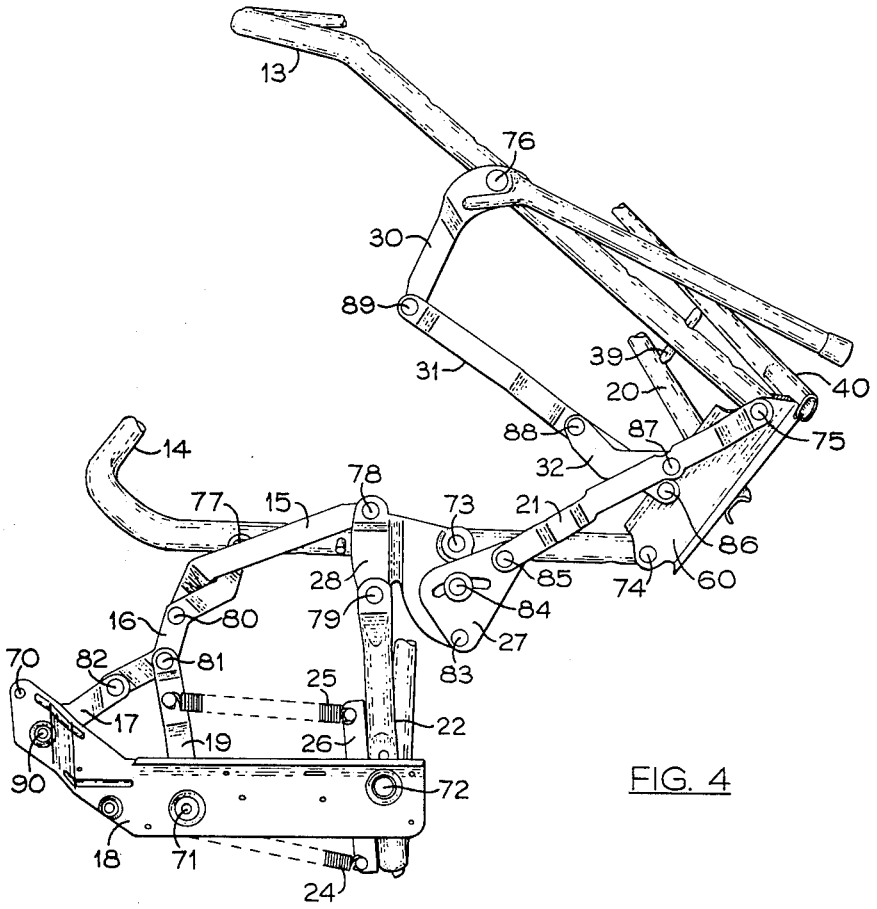
FIG. 4 is a comprehensive detail of the bed mechanism linkages when the inward side of the bed is set in the 'bed' position and the outward side is part-away through its path of travel towards becoming the outward side of the bed.
Figure 6:
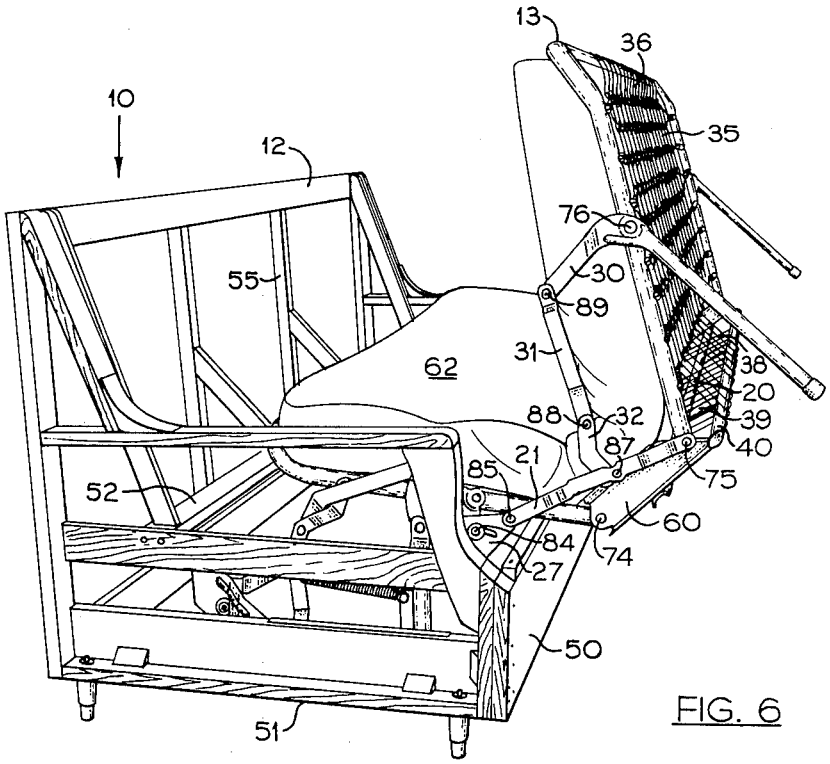
FIG. 6 is a complete perspective view of the convertible bed mechanism with a mattress in place and connected to an upholstered bed frame with the outward side being in the half-way position of the folding stage and showing the two folding legs being folded by their particular linkages.

The second stage of forming a double bed as shown in FIG. 5 is for the user to pull tube 13 upward and outward from the position of FIG. 3. FIGS. 4 and 6 show the movement of the mechanism outward with leg 30 and associated linkage 31 and 32 being carried and moved to rest in a floor engaging posture as in FIG. 5.

The upper or front tube 13 and lower or rear tube 14 each provide a rectangular shaped frame member to the bed and are spaced apart by channel members 60 which have flanged outward edges as shown. The other sides of the tubes where they fold toward one another are inwardly curved to give the appearance of a pair of clam shells, which shape prevents the mattress from shifting or sliding out when the mechanism is moved into or out of the folded position. The edge shape of tubing also assists the bed to clear the back rail of the sofa and to clear the floor when moved. Frame tubes 13 and 14 are pivotably attached to the channel member 60. The channel 60 of one end is attached to the channel of the other end of the bed by tube members 20 and 40 which between the provide rigidity to the centre section of the bed and provide stability to the structure as a whole. When the bed is in the outstretched position, part of the load is carried by the pair of legs 30 and the remainder is carried to swing lever plate 28 as attached to tube 14 at rivet 73 where it is transmitted to base plate 18 by main torsion bar tube 22. Tube 22 is 'U' shaped and connected to both end base plates and to either end of tube 14 through plate 28, thereby giving unusually good stability to the bed and providing union of movement of the pairs of linkages on the sides of the bed, thereby creating a smooth operation to the whole.

Lock plate 27 is pivotably attached at 83 to swing lever 28 and also attached to swing lever 28 by pin 84 fixed in the lever 28 to allow plate 27, limited movement in an arc as indicated by the shape of the slot guide. When the bed is in the sprungup position after the completion of stage 1, the lock plate is back toward the torsion tube 22, (FIG. 3), but as the outer side of the bed is folded out, the lock plate 27 moves forward over guide pin 84 until stopped by the end of the slot. In this forward position, the lock plate 27 combines with lock lever 21 to lock the outer side downward toward the floor and to resist a weight on the inner side of the bed from causing the outer side to flip up and fold in. The lock lever 21 is pivoted to the outer end of side channel 60 at 75 and pivotted to lock plate 27 at 85 and will brace the mid-portion of the outer side to the swing lever 28 and torsion tube 22, thereby adding strength to the mid-section of the bed and eliminating the need for a middle leg. Lock lever is partially supported and stopped by a flange on channel 60 as seen in FIG. 5.

Link 32 is pivotted on link 31 and 88 and attached and pivotted on link 21 at pivot 87. It provides an upward bracing between lock lever 21 and leg link 31 when they are both aligned along and between the outfolded sides of the bed.

Brace or Bridge link 32, completes the chain of linkages between the leg 30 across the end of the bed and down to the base plate 18. The chain of linkages provides the tensed upward thrusting rigidity to prevent the bed from collapsing when in the loaded and outstretched position. From FIG. 5 the link 32 is connected to link 21 at a point 87 below the stress point 86 of leg link 31, thereby concentrating the upward thrust at the point of greatest strain in the bed midway between leg 30 and base 18, since its pivot at 88 produces the bridging upthrust. The lock provided by link 32 as above discussed is broken at a position of folding shown in FIG. 4 where link 32 converts into a compression link to draw link 31 downward and to thrust link 21 inward and downward to counter the reaction of the mattress to being folded. It is known that inner spring and foam mattresses resist 180° folding and an operator will therefore require pressure assistance from the linkage to force the mattress to fold. Link 32 will therefore cause link 21 to push plate 27 backwards and align rivets 83, 84 and 85, which will in the folding operation assist the operator to break the lock of links 15 and 16, resulting in a smooth easy folding operation for a person of moderate strength such as a housewife.

It will be apparent from the above that the preferred embodiment of the invention contemplates the chesterfield bed disclosed to be frequently folded and unfolded and therefore has as its principle object space saving and ease of operation. The invention herein departs from the usual pull-out type bed that has the head in the sofa seat and foot pulled into the room. I have returned to the older practice of having the bed a double one side by side with the chesterfield with one side using the space occupied by the chesterfield. By so doing, a great deal of room space can be saved by and my sofa bed can be used in smaller areas that heretofore required much floor space in front of the chesterfield to accommodate a pull-out double bed.

What I claim is:

1. Convertible furniture comprising in combination;

a chesterfield frame having a back, two opposite sides and a front with a level top edge thereto;

a back deck rail attached between said sides forward of the back and above the top of said front top edge;

a bed frame having a spring attached thereto and a mattress held thereon, said bed frame being collapsibly storable within said chesterfield frame below said front top edge and partly beneath said back deck rail, whereby said bed frame when stored within the chesterfield frame provides the seat cushion support for said chesterfield;

said bed frame, when collapsed, comprising an upper and lower U-shaped member disposed in spaced apart relationship by a pair of channel members, said channel members being pivotably attached to the ends of the legs of the U-shaped members;

linked mesh wire fabric attached to the U-shaped members and between them to form said bed spring and provide a mattress support therebetween; a base plate attached to each side of said chesterfield frame and having a forward and rearward end thereon;

a main torsion support tube pivotably attached to the forward end of each base plate and pivotably linked to a pair of swing levers, one swing lever being attached to one leg of the U-shaped lower bed frame member and the other swing lever being attached to the other end of the lower U-shaped bed frame member;

a lock linkage pivotably connected between a rearward end of each base plate and one of the pair of swing levers, to provide a brace to the lower bed frame when the bed is in the unfolded position and being collapsible when the folded bed frame and mattress combination are thrust beneath the back deck rail;

a separate support leg pivotably connected to the ends of the upper U-shaped bed frame member, said legs being storable parallel with the frame member of the bed when in the collapsed position and being extensible into load bearing position when the frames and channels are in outwardly extended by means of a linkage arm connected between the channel members and the legs.

2. Convertible furniture as claimed in claim 1, a rigid member attached to the channel members to provide a hard front edge to the bed frame when in folded position and having a plurality of spring steel links connected to the link fabric and sprung over said rigid member to combine therewith to provide a cushion support between the folded link fabric and the chesterfield front frame top edge; and having a lock lever connected between each channel of the bed frame and the swing levers to provide rigidity to the bed when outwardly extended.

* * * * *